US005629051A

United States Patent [19]

Poliniak

[11] Patent Number: 5,629,051

[45] Date of Patent: May 13, 1997

[54] METHOD AND APPARATUS FOR FORMING AN INSULATOR ON A UNIAXIAL TENSION FOCUS MASK OF A COLOR SELECTION ELECTRODE

[75] Inventor: Eugene S. Poliniak, Willingboro, N.J.

[73] Assignee: Thomson Multimedia, S. A., Courbevoie, France

[21] Appl. No.: 529,892

[22] Filed: Sep. 18, 1995

[51] Int. Cl.[6] ..... B05D 1/06; B05B 5/025; B05B 5/047

[52] U.S. Cl. ..... 427/475; 427/68; 427/71; 427/478; 427/480; 118/624; 118/627; 118/628

[58] Field of Search ..... 427/470, 475, 427/478, 64, 68, 71, 480; 118/624, 627, 628, 629; 445/58

[56] References Cited

U.S. PATENT DOCUMENTS

| | | | |
|---|---|---|---|
| 3,578,486 | 5/1971 | Fenton | 118/628 |
| 3,811,910 | 5/1974 | Labana et al. | 117/17 |
| 4,470,822 | 9/1984 | Bloom et al. | 445/5 |
| 5,078,812 | 1/1992 | McCoy et al. | 148/270 |
| 5,238,709 | 8/1993 | Wilkie | 427/475 |

*Primary Examiner*—Bejamin Utech
*Assistant Examiner*—Fred J. Parker
*Attorney, Agent, or Firm*—Joseph S. Tripoli; Dennis H. Irlbeck; Vincent J. Coughlin, Jr.

[57] ABSTRACT

A method and apparatus for forming an insulator 62 on one major surface of a uniaxial tension focus mask 25 includes the steps of: positioning a mask sheet 27, having a multiplicity of openings 42 that extend from a first major surface of the mask sheet through a main body portion thereof to an oppositely disposed second major surface, at a distance from a charging gun 72, 172 having a source 74, 174 of a dry-powdered insulative material; charging and directing the dry-powdered insulative material toward the first major surface of the mask to provide a coating of the charged, dry-powdered insulative material thereon, and providing means 70, 272 for preventing the charged, dry-powdered insulative material from extending into the openings 42 and being deposited onto the main body portion of the mask surrounding the openings and the second major surface. The mask sheet 27, with the charged, dry-powdered insulative material on the first major surface thereof, is then heated to a temperature sufficient to sinter the insulative material. An apparatus for practicing this method also is described.

11 Claims, 4 Drawing Sheets

Fig. 2
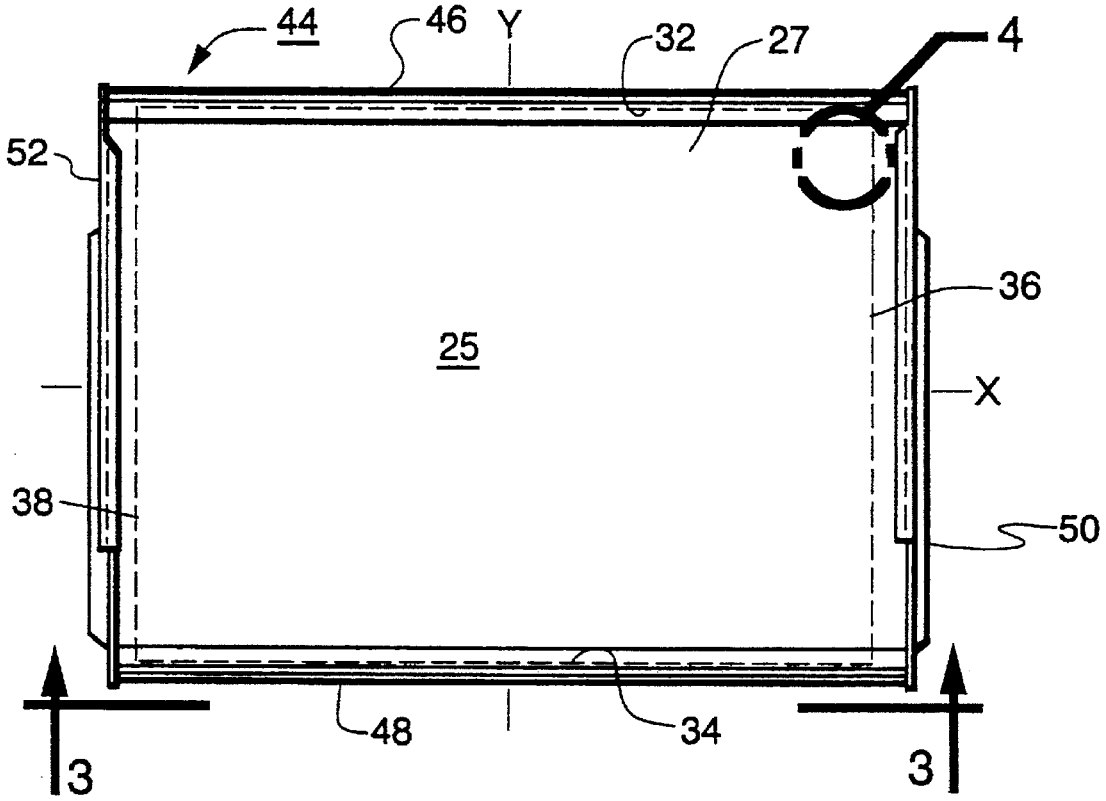
Fig. 3
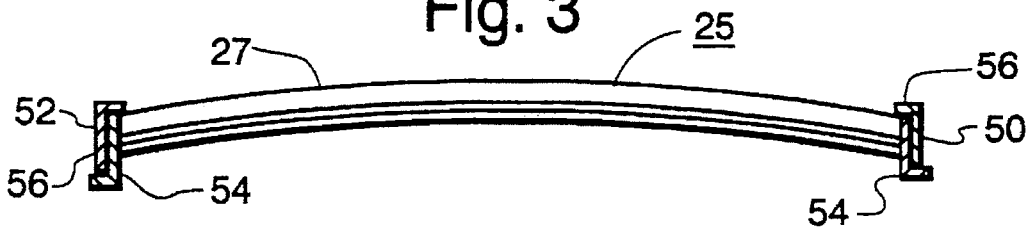
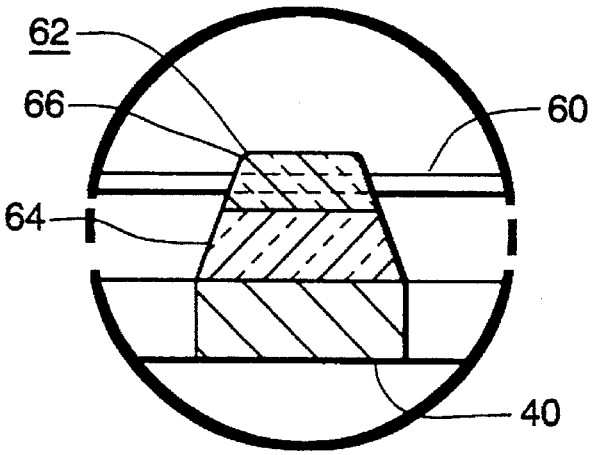
Fig. 6

METHOD AND APPARATUS FOR FORMING AN INSULATOR ON A UNIAXIAL TENSION FOCUS MASK OF A COLOR SELECTION ELECTRODE

This invention relates to a method and apparatus for forming an insulator on a major surface of a color selection electrode for a cathode-ray robe (CRT) and, more particularly, to a color CKT having a uniaxial tension focus mask made by the present method and apparatus.

BACKGROUND OF THE INVENTION

One type of uniaxial tension focus mask has a plurality of spaced-apart first metal strands located adjacent to an effective picture area of the screen of the CRT. The spacing between the first metal strands defines a plurality of slots substantially parallel to the phosphor lines of the screen. Each of the first metal strands, across the effective picture area of the screen, has a substantially continuous first insulator layer on a screen-facing side thereof. A second insulator layer overlies the first insulator layer. A plurality of second metal strands are oriented substantially perpendicular to the first metal strands and are bonded thereto by the second insulator layer. During operation of the uniaxial tension focus mask two different potentials are applied to the first and second metal strands to focus the electron beams transmitted through the slots in the focus mask.

A method of making the uniaxial tension focus mask includes prodding, e.g., by conventional spraying, a first coating of an insulative, devitrifying solder glass onto the screen-facing side of the first metal strands of a mask sheet. A suitable solvent and an acrylic binder are mixed with the devitrifying solder glass to give the first coating a modest degree of mechanical strength. A devitrifying solder glass is one that melts at a specific temperature to form a crystallized glass insulator. The resultant crystallized glass insulator is stable and will not remelt when reheated to the same temperature. The first coating has a thickness of about 0.14 mm. A frame, to which the mask sheet is attached, is placed into an oven and the first coating is dried at a temperature of about 80° C. After drying, the first coating is contoured so that it is shielded by the first metal strands to prevent the electron beams, passing thought the slots, from impinging upon the insulator and charging it. The contouring is performed on the first coating by abrading or otherwise removing any of the solder glass material of the first coating that extends beyond the edge of the first metal strands and would be contacted by either the deflected or undeflected electron beams. The frame with the mask sheet attached thereto is placed into an oven and heated in air. The structure comprising the frame and mask sheet are heated over a period of 30 minutes, to a temperature of 300° C. and held at 300° C., for 20 minutes. Then, over a period of 20 minutes, the temperature of the oven is increased to 460° C. and held at that temperature for one hour, to melt and crystallize the first coating to form a first insulator layer on the first metal strands. The resultant first insulator layer is only substantially continuous; i.e., the layer includes voids caused by baking out the binder and the solvent that are used to deposit the conventionally sprayed first coating. The first insulator layer, after firing, has a thickness within the range of 0.5 to 0.9 mm (2 to 3.5 mils) across each of the first metal strands. Next, a second coating of a suitable insulative material, mixed with a solvent, is applied, e.g., by conventional spraying, to the first insulator layer. Preferably, the second coating is a non-devitrifying (i.e., vitreous) solder glass. Vitreous solder glass is preferred for the second coating because when it melts, it will fill the aforementioned voids in the surface of the first insulator layer without adversely affecting the electrical and mechanical characteristics of the first insulator layer. Alternatively, a devitrifying solder glass may be used to form the second coating. The second coating is applied to a thickness of about 0.025 to 0.05 mm (1 to 2 mils). The second coating is dried at a temperature of 80° C. and contoured, as previously described, to remove any excess material that could be struck by the electron beams. Subsequently, second metal strands are applied to overlie the second coating of insulative material. The second metal strands are substantially perpendicular to the first metal strands.

The conventional spraying steps for the first and second insulator layers require the mixing of a dry glass material with at least a suitable solvent, and usually a binder. The conventional spraying steps are wasteful of the insulative material, because most of the insulative material passes through the large slots, or openings, in the mask sheet. Additionally, the excess material cannot be salvaged, and a drying step is required, prior to the firing step that solidifies the sprayed mixture into a glass insulator layer. Furthermore, conventionally sprayed material usually adheres not only to the edges of the mask openings, but often splatters onto the oppositely disposed gun-facing surface of the first metal strands; the material must be removed therefrom and from the edge of the openings, to prevent charging of the insulator by the electron beams.

It is desirable to eliminate the above-described waste of insulative material and to decrease the time required to make the uniaxial tension focus mask by simplifying the steps of applying the insulative material to form the insulator on the mask sheet. Also, it is desirable to provide a first insulator that does not contain voids, in order to increase the electrical integrity of the uniaxial tension focus mask.

SUMMARY OF THE INVENTION

A method and apparatus for forming an insulator on one major surface of a uniaxial tension focus mask includes the steps of: positioning a mask sheet, having a multiplicity of openings that extend from a first major surface of the mask sheet through a main body portion thereof to an oppositely disposed second major surface, at a distance from a charging gun having a source of a dry-powdered insulative material; charging and directing the dry-powdered insulative material toward the first major surface of the mask sheet to provide a coating of the charged, dry-powdered insulative material on at least a portion of said first major surface, and providing means for preventing the charged, dry-powdered insulative material from extending into the openings and being deposited onto the main body portion of the mask sheet surrounding the openings and the second major surface. An apparatus for practicing this method also is described.

BRIEF DESCRIPTION OF THE DRAWINGS

The invention will now be described in greater detail, with relation to the accompanying drawings, in which:

FIG. 2 is a plan view of a uniaxial tension focus mask used in the CRT of FIG. 1;

FIG. 3 is a front view of the uniaxial tension focus mask taken along line 3—3 of FIG. 2;

FIG. 6 is an enlarged view of a portion of the uniaxial tension focus mask within the circle 6 of FIG. 5;

DETAILED DESCRIPTION OF THE PREFERRED EMBODIMENTS

Figure 1:
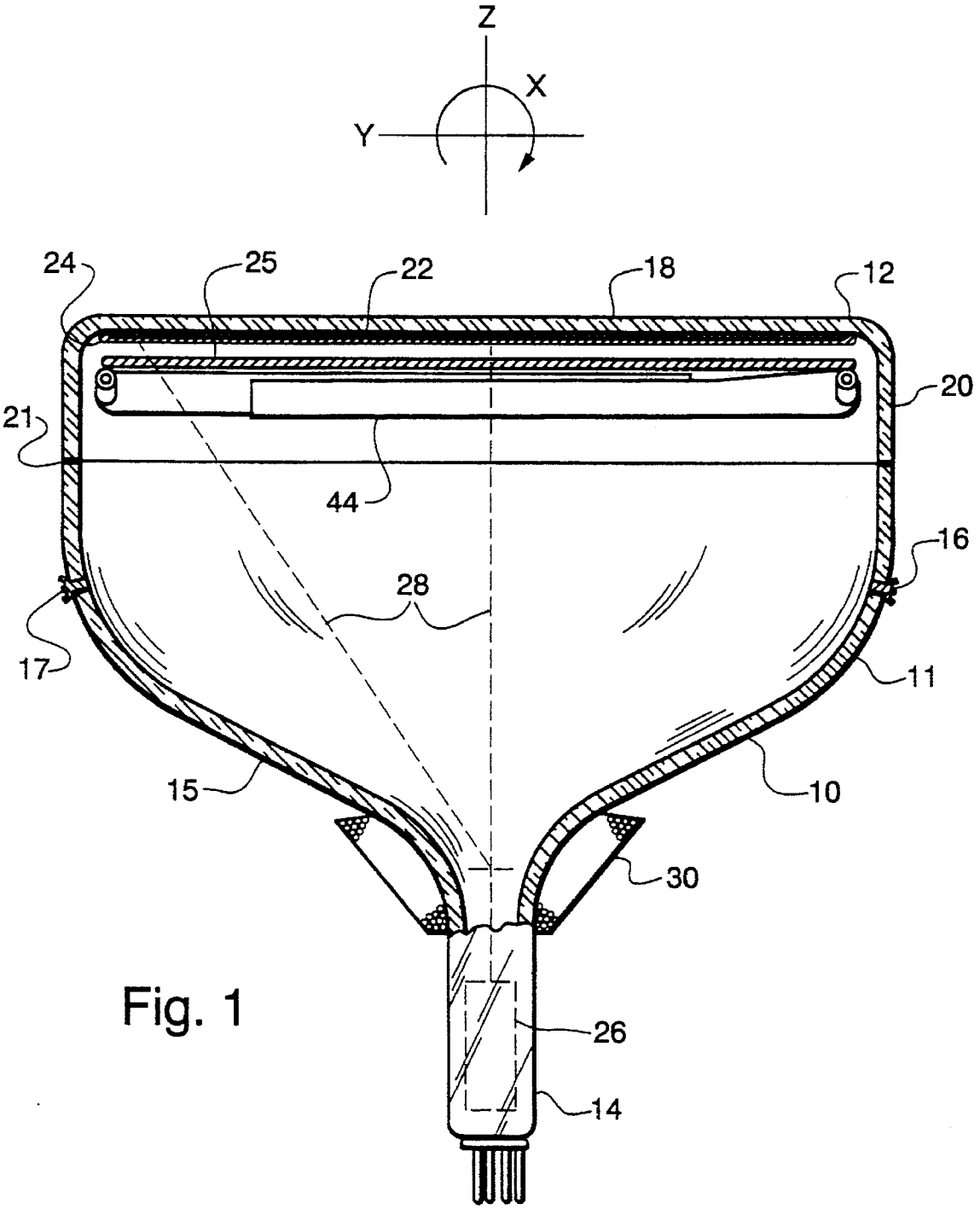
FIG. 1 is a plan view, partly in axial section, of a color CRT made according to the invention.

FIG. 1 shows a color CRT 10 having a glass envelope 11 comprising a rectangular faceplate panel 12 and a tubular neck 14 connected by a rectangular funnel 15. The funnel has an internal conductive coating (not shown) that is in contact with, and extends from, a first anode button 16 to the neck 14. A second anode button 17, located opposite the first anode button 16, is not contacted by the conductive coating. The panel 12 comprises a cylindrical viewing faceplate 18 and a peripheral flange or sidewall 20 that is sealed to the funnel 15 by a glass frit 21. A three-color luminescent phosphor screen 22 is carried by the inner surface of the faceplate 18. The screen 22 is a line screen, shown in detail in FIG. 5, that includes a multiplicity of screen elements comprised of red-emitting, green-emitting, and blue-emitting phosphor lines, R, G, and B, respectively, arranged in triads, each triad including a phosphor line of each of the three colors. Preferably, a light absorbing matrix 23 separates the phosphor lines. A thin conductive layer 24, typically of aluminum, overlies the screen 22 and provides means for applying a uniform first anode potential to the screen as well as for reflecting light, emitted from the phosphor elements, through the faceplate 18. A cylindrical multi-apertured color selection electrode, such as a uniaxial tension focus mask, 25 is removably mounted, by conventional means, within the panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the mask 25 to the screen 22. The inline direction of the beams 28 is normal to the plane of the paper.

Figure 4:
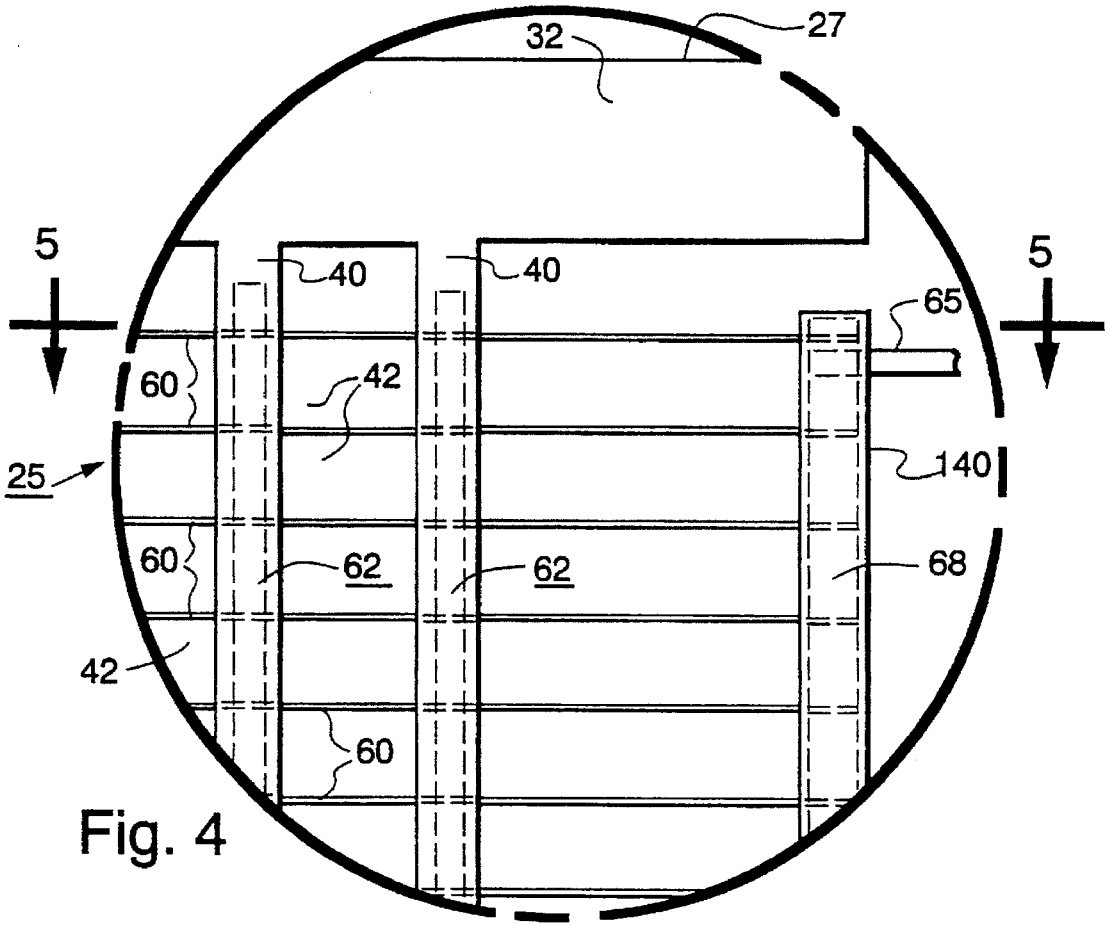
FIG. 4 is an enlarged section of the uniaxial tension focus mask shown within the circle 4 of FIG. 2.

The CRT of FIG. 1 is designed to be used with an external magnetic deflection yoke, such as the yoke 30, shown in the neighborhood of the funnel-to-neck junction. When activated, the yoke 30 subjects the three beams to magnetic fields that cause the beams to scan a horizontal and vertical rectangular raster over the screen 22. The uniaxial tension focus mask 25 is formed, preferably, from a thin rectangular mask sheet 27 of about 0.05 mm (2 mil) thick low carbon steel, that is shown in FIG. 2 and includes two long sides 32, 34 and two short sides 36, 38. The two long sides 32, 34 of the mask sheet 27 parallel the central major axis, X, of the CRT and the two short sides 36, 38 parallel the central minor axis, Y, of the CRT. The steel has a composition, by weight, of about 0.005% carbon, 0.01% silicon, 0.12% phosphorus, 0.43% manganese, and 0.007% sulfur. Preferably, the ASTM grain size of the mask sheet is within the range of 9 to 10. The uniaxial tension focus mask 25 includes an apertured portion that is adjacent to and overlies an effective picture area of the screen 22 which lies within the central dashed lines of FIG. 2 that define the perimeter of the mask 25. As shown in FIG. 4, the rectangular mask sheet 27 of the uniaxial tension focus mask 25 includes a plurality of elongated first metal strands 40, each having a transverse dimension, or width, of about 0.3 mm (12 mils) separated by substantially equally spaced slots 42, each having a width of about 0.55 mm (21.5 mils), that parallel the minor axis, Y, of the CRT and the phosphor lines of the screen 22. In a color CRT having a diagonal dimension of 68 cm (27V), there are about 600 of the first metal strands 40. Each of the slots 42 extends from the long side 32 of the mask sheet to the other long side 34, not shown in FIG. 4. A frame 44, for the mask 25, is shown in FIGS. 1 and 2 and includes four major members, two torsion tubes, or curved members, 46 and 48 and two tension arms, or straight members, 50 and 52. The two curved members, 46 and 48, parallel the major axis, X, and each other. As shown in FIG. 3, each of the straight members 50 and 52 includes two overlapped partial members, or parts, 54 and 56, each part having an L-shaped cross-section. The overlapped parts 54 and 56 are welded together where they are overlapped. An end of each of the parts 54 and 56 is attached to an end of one of the curved members 46 and 48. The curvature of the curved members 46 and 48 matches the cylindrical curvature of the uniaxial tension focus mask 25. The long sides 32, 34 of the mask sheet 27 are welded between the two curved members 46 and 48 which provide the necessary tension to the mask 25. Before welding to the frame 44, the mask sheet 27 is prestressed and darkened by tensioning the mask sheet while heating it, in a controlled atmosphere of nitrogen and oxygen, at a temperature of about 500° C. for one hour.

Figure 5:
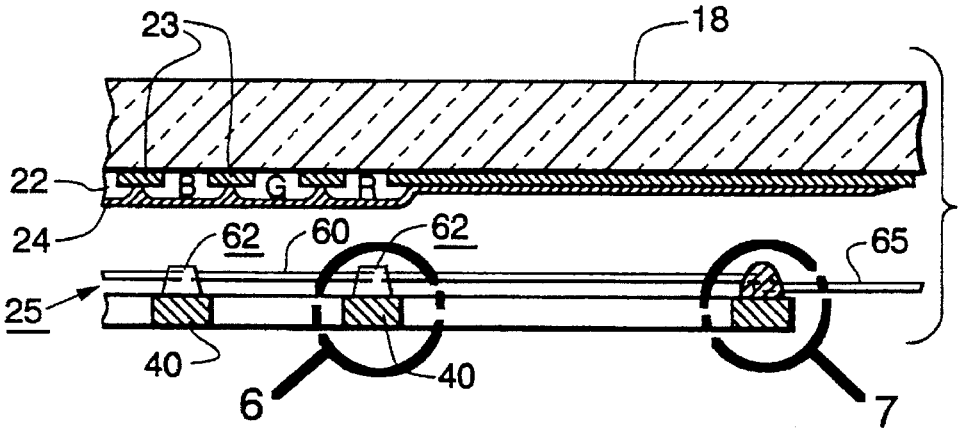
FIG. 5 is a section of the uniaxial tension focus mask and the luminescent screen taken along lines 5—5 of FIG. 4.

With reference to FIGS. 4 and 5, a plurality of second metal strands 60, each having a diameter of about 0.025 mm (1 mil), are disposed substantially perpendicular to the first metal strands 40 and are spaced therefrom by an insulator 62 formed on the screen-facing side of each of the first metal strands. The second metal strands 60 form cross members that facilitate applying a second anode, or focusing, potential to the mask 25. The preferred material for the second metal strands is HyMu80 wire, available from Carpenter Technology, Reading, Pa. The vertical spacing, or pitch, between adjacent second strands 60 is about 0.41 mm (16 mils). The relatively thin second metal strands 60 provide the essential focusing function to the present uniaxial tension focus mask 25 without adversely affecting the electron beam transmission thereof. The uniaxial tension focus mask 25, described herein, provides a mask transmission, at the center of the screen, of about 60%, compared to a conventional shadow mask having a center transmission of only about 18–22%, and requires that the second anode, or focusing, voltage, $\Delta V$, applied to second strands 60, differs from the first anode voltage applied to the first metal strands 40 by less than about 1 kV, for a first anode voltage of about 30 kV.

The insulators 62, shown in FIGS. 4, 5 and 6 are disposed continuously on the screen-facing side of each of the first metal strands 40. The second metal strands 60 are bonded to the insulators 62 to electrically isolate the second metal strands 60 from the first metal strands 40.

EXAMPLE 1

Figure 8:
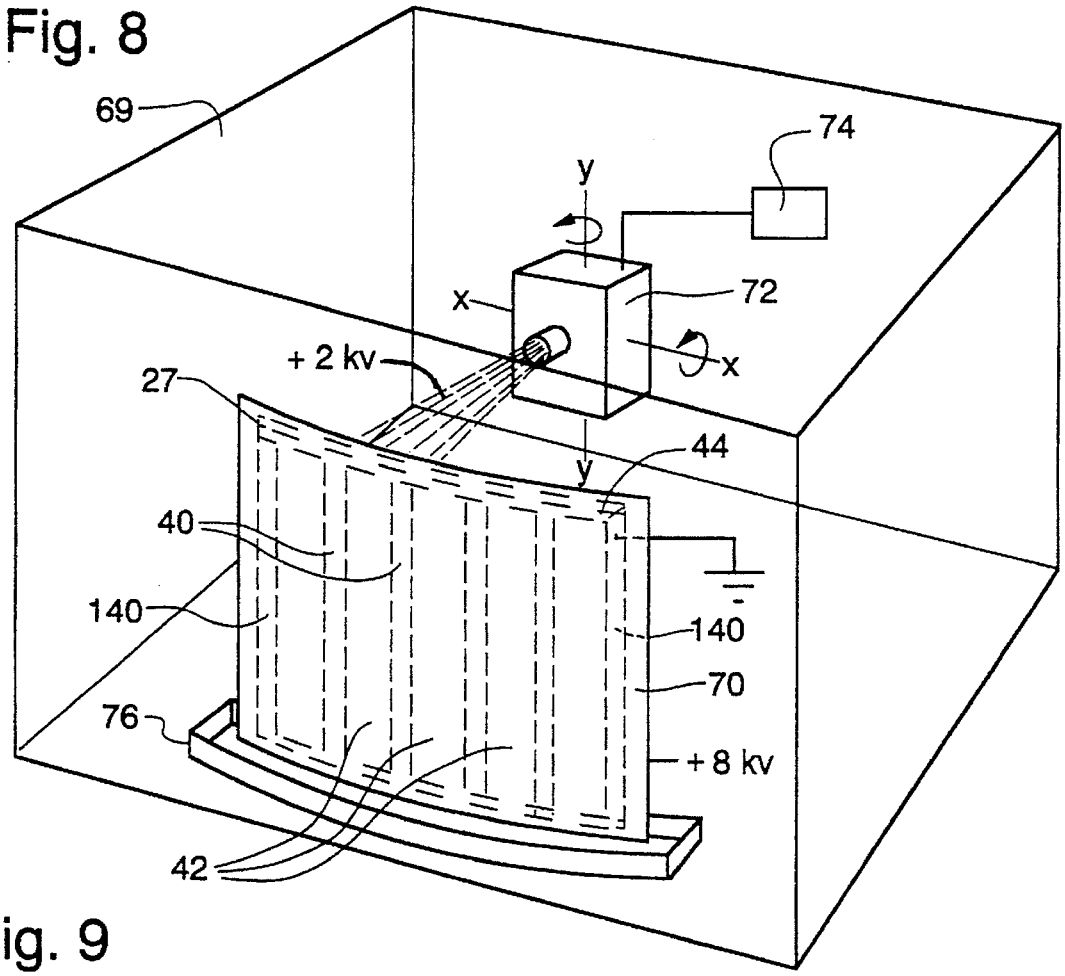
FIG. 8 shows a first method of forming a coating of an insulative material on a mask sheet of the uniaxial tension focus mask.

A first method and apparatus for forming the insulators 62 on the screen-facing side, or first major surface, of the first metal strands 40 is shown in FIG. 8. The mask sheet 27, with the attached frame 44, is placed within an enclosure 69 and positioned adjacent to a shield 70 that is at a potential of about +8 kV. The shield 70, has a curvature that corresponds to the curvature of the mask frame 44 and the mask sheet 27, and may be an insulator that is electrostatically charged to a desired potential, or a conductor to which a desired potential is applied. The mask sheet 27 is grounded and positioned at a distance from a gun 72 that has a source 74 of dry-powdered insulative material, such as particles of a devitrified solder glass, contained therein. The gun 72 is pivotally mounted so that it will rotate about the X-axis and the Y-axis of the mask sheet to provide complete coverage of the first major surface of the first metal strands 40. A preferred solder glass is available as CV 685, from OI NEG, TV products Inc., Columbus, Ohio. The gun 72 may be a triboelectric gun which charges the glass particles by friction to a positive potential less than the potential applied to the shield 70. The triboelectric gun 72 directs the positively charged glass particles toward the grounded first major surface of the strands 40 to provide a continuous coating thereon. The positive charge of about 8 kV on the shield 70 is sufficient to repel the less positively charged glass particles from the open areas of the mask sheet 27 and prevents them from entering into the openings, or slots, 42 and from being deposited onto the main body portion of the mask sheet that surrounds the slots 42. Additionally, the charged glass particles also are prevented from being deposited onto the gun-facing side, or second major surface, of the first metal strands 40. The devitrified solder glass is deposited as a dry, charged material, having a continuous coating thickness of about 0.5 to 0.9 mm (2 to 3.5 mils). The thickness of the resultant layer is dependent on the time of spraying. For example, it is possible to increase the thickness of the layer by spraying for a longer peiod of time. Additionally, the repulsive field provided by the shield 70 is sufficient to affect the distribution of the charged solder glass particles on the first metal strands 40. The coating of glass particles is thinner at the edges of the first metal strands 40, where the repulsive effect of the field from the shield 70 is stronger, than in the center of the first metal strands, where the repulsive effect of the field is weaker. Thus, it is unnecessary to contour the edges of the coating, before firing it, to prevent the subsequent impingement thereon of the electron beams. The glass particles repelled by the shield and not deposited onto the first metal strands 40 are accumulated in an open container 76 for recycling. The first coating is entirely removed, by modest mechanical action, from the initial and ultimate, i.e., the right and left first metal strands, hereinafter designated the first metal end strands 140, before the first coating is heated to the sintering temperature. The first metal end strands 140, which are outside of the effective picture area, subsequently will be used as busbars to address the second metal strands 60. To further ensure the electrical integrity of the uniaxial tension focus mask 25, at least one additional first metal strand 40 is removed between the first metal end strands 140 and the first metal strands 40 that overlie the effective picture area of the screen, to minimize the possibility of a short circuit. Thus, the right and left first metal end strands 140, outside the effective picture area, are spaced from the first metal strands 40 that overlie the picture area by a distance of at least 1.4 mm (55 mils), which is greater than the width of the equally spaced slots 42 that separate the first metal strands 40 across the picture area.

Figure 10:
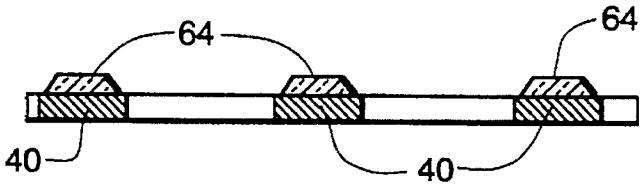
FIG. 10 shows a coating of the insulative material according to the present invention.

The mask sheet 27 and the attached frame 44 are placed into an oven (not shown) and heated in air to a temperature of about 460° C., at a rate of about 1° C./min., to melt and crystallize the glass of the first coating layer to form, on the first metal strands 40, a first insulator layer 64, shown in FIG. 10. The resultant first insulator layer 64, after firing, has a thickness that is substantially equal to that of the applied coating, because no binder or solvent, that would bake out during firing, is added to the glass particles of the first coating layer. The lack of a binder and solvent in the first coating layer also prevents formation of voids. Because the first coating layer is formed of dry, charged glass particles, it also is unnecessary, in the present method, to dry the coating before firing it to melt, or sinter, the devitrified glass particles to form the first layer 64 of the insulator 62.

After the first insulator layer 64 is formed, the second metal strands 60 are applied thereto so that the second metal strands 60 overlie the first insulative layer and are substantially perpendicular to the first metal strands 40. The second metal strands 60 are applied using a winding fixture, not shown, that accurately maintains the desired spacing of about 0.41 mm between the adjacent second metal strands.

Figure 7:
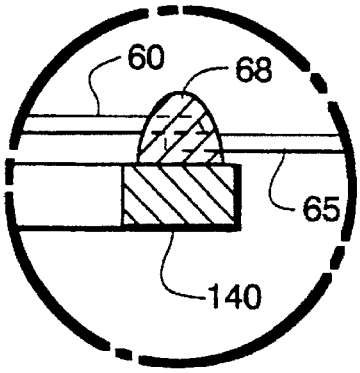
FIG. 7 is an enlarged view of another portion of the uniaxial tension focus mask within the circle 7 of FIG. 5.

As shown in FIGS. 4, 5 and 7, a thick coating of the above-described devitrifying solder glass, containing a quantity of silver to render it conductive, is provided onto the screen-facing side of the left and right first metal end strands 140. The conductive solder glass is provided as described hereinafter. A conductive lead 65, formed from a short length of nickel wire, is provided on one of the first metal end strands 140, within the conductive solder glass.

The mask sheet 27, the frame 44 and the winding fixture (not shown) are then grounded and repositioned adjacent to the shield 70 that is at a potential of about +8 kV. The mask sheet is positioned at a distance from the triboelectric gun 72 that has the source 74 of dry-powdered insulative material therein, to provide a second coating of a suitable insulative material that is applied to the first insulator layer 64. Either a vitreous solder glass or the same devitrifying solder glass, used to form the first insulator layer 64, may be used to form the second coating. The second coating is applied to a thickness of about 0.013 to 0.025 mm (0.5 to 1 mil). Because the second coating is formed of dry, charged glass particles, it also is unnecessary, in the present method, to dry the coating before firing it to melt, or sinter, the devitrified glass particles to form the second insulator layer 66.

The resultant structure, including the winding fixture, is heated to a temperature of 460° C. to melt the second coating of insulative material, as well as the conductive solder glass, to bond the second metal strands 60 within the second insulator layer 66 of the insulator 62, as shown in FIG. 6. The sintering step also forms the glass conductive layer 68 on the left and right first metal end strands 140, as shown in FIG. 7. The resultant second insulator layer 66, after firing, has a thickness substantially equal to the coating thickness of 0.013 to 0.125 mm, because there is very little compaction of the glass powder during firing. The height of the glass conductor layer 68 is not critical, but should be sufficiently thick to firmly anchor the second metal strands 60 and the conductive lead 65 therein. The portions of the second metal strands 60 extending beyond the glass conductor layer 68 are trimmed to free the assembly from the winding fixture. The completed structure, after firing comprises the uniaxial tension focus mask 25.

The first metal end strands 140 are severed at the ends adjacent to top portion or long side 32, shown in FIG. 4, and bottom portion or long side 34 (not shown) of the mask 25 to provide gaps of about 0.4 mm (15 mils) therebetween that electrically isolate the first metal end strands 140 and form busbars that permit a second anode voltage to be applied to the second metal strands 60 when the conductive lead 65, embedded in the glass conductor layer 68, is connected to the second anode button 17.

EXAMPLE 2

Figure 9:
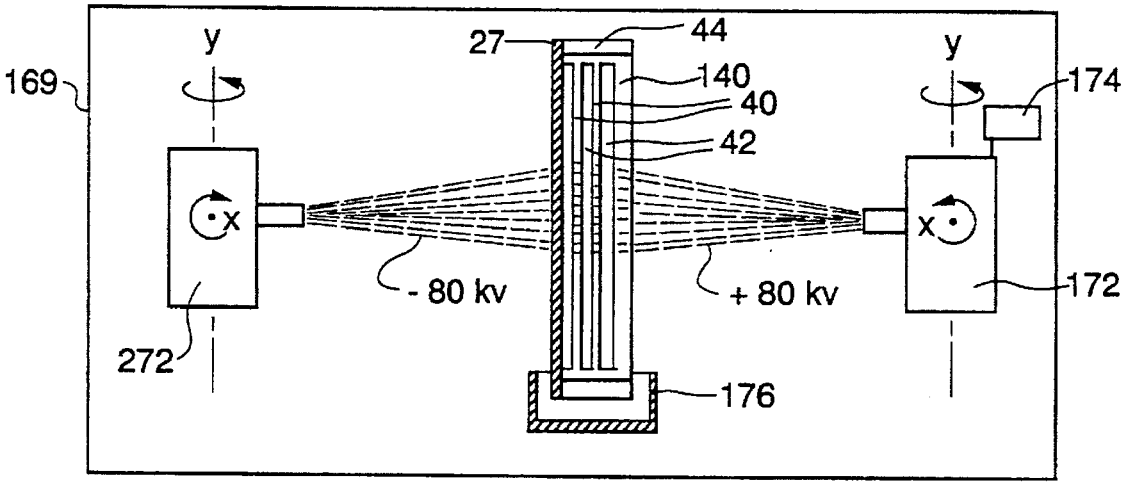
FIG. 9 shows a second method of forming the coating of the insulative material on the mask sheet of the uniaxial tension focus mask.

In a second method of forming the insulator 62 on the first metal strands 40 and the glass conductive layer 68 on the first metal end strands 140, a primary electrostatic gun 172 and a secondary electrostatic gun 272 are mounted in face-to-face relationship, within a suitable enclosure 169, as indicated in FIG. 9. A suitable electrostatic gun includes models 701, 702 and 705, available from ITW Ransburg, Toledo, Ohio. A source 174 of solder glass particles communicates with the gun 172. The gun 172 has the capability of electrostatic charging the glass particles to a potential of about +80 kV. The secondary electrostatic gun 272 is mounted opposite to the primary electrostatic gun 172 and is capable of electrostatically charging a stream of air to an equal and opposite potential of about −80 kV. Each of the electrostatic guns 172 and 272 is pivotally mounted to provide full X-axis and Y-axis coverage of the first metal strands 40 of the mask sheet 27. In fact, the movement of the secondary gun 272 is such that it tracks the movement of the primary gun 172 and discharges any of the electrostatically charged particles of solder glass that pass through the slots 42 in the mask sheet 27. The discharged glass particles are accumulated in a collector 176 for recycling. The primary electrostatic gun 172 provides a substantially uniform layer of devitrifying solder glass on the first major surface of each of the first metal strands 40. The first coating is entirely removed, by modest mechanical action, from the right and left first metal end strands 140, before the first coating is heated to the sintering temperature. The first metal end strands 140, which are outside of the effective picture area, subsequently will be used as busbars to address the second metal strands 60. To further ensure the electrical integrity of the uniaxial tension focus mask 25, at least one additional first metal strand 40 is removed between the first metal end strands 140 and the first metal strands 40 that overlie the effective picture area of the screen, to minimize the possibility of a short circuit. Thus, the right and left first metal end strands 140, outside the effective picture area, are spaced from the first metal strands 40 that overlie the effective picture area by a distance of at least 1.4 mm (55 mils), which is greater than the width of the equally spaced slots 42 that separate the first metal strands 40 across the picture area.

The mask sheet 27 and the attached frame 44 are placed into an oven (not shown) and heated in air to a temperature of about 460° C., at a rate of about 1° C./min., to melt and crystallize the first coating to form the first insulator layer 64 on the first metal strands 40. The resultant first insulator layer 64, after firing, typically has a thickness within the range of 0.5 to 0.9 mm (2 to 3.5 mils). The coating thickness again depends on the deposition time. Because the coating is formed of dry, charged glass particles, it also is unnecessary, in the present method, to dry the coating before firing it to melt, or sinter, the devitrified glass particles to form the first layer 64 of the insulator 62. Additionally, by adjusting the air pressure of each of the electrostatic guns 172 and 272, the distribution of the glass particles of the coating can be contoured while the coating is being deposited onto the first metal strands 40. The contoured coating that forms the first insulator layer 64 is thinner at the edges of the strands 40 than in the center portions thereof, as shown in FIG. 10.

Then, the second metal strands 60 are applied to the first insulator layer 64, so that the second metal strands 60 overlie the first insulative layer and are substantially perpendicular to the first metal strands 40. The second metal strands 60 are applied using a winding fixture, not shown, that accurately maintains the desired spacing of about 0.41 mm between the adjacent second metal strands.

The mask sheet 27, the frame 44 and the winding fixture (not shown), with the second metal strands 60 that form the cross strands, are positioned between the first and second electrostatic guns 172 and 272, respectively, and a second coating of a suitable insulative material is applied to the first insulator layer 64.

As shown in FIGS. 4, 5 and 7, a thick coating of the above-described devitrifying solder glass, containing a quantity of silver to render it conductive, is then provided onto the screen-facing side of the left and right first metal end strands 140. The conductive solder glass is deposited either by electrostatically charging and spraying the dry, conductive solder glass onto the screen-facing side of the left and right first metal end strands 140 or by conventionally spraying a conductive solder glass and suitable solvent and binder, if required, onto the first metal end strands. A conductive lead 65, formed from a short length of nickel wire, is provided on one of the first metal end strands 140, within the conductive solder glass. The assembly, including the winding fixture, is then heated to a temperature of 460° C. to melt the second coating of insulative material, as well as the conductive solder glass, to bond the second metal strands 60 within both the second insulator layer 66 and a glass conductor layer 68. The second insulator layer 66 has a thickness, after sintering, of about 0.013 to 0.025 mm.

The first metal end strands 140 are severed at the ends adjacent to top portion or long side 32, shown in FIG. 4, and bottom portion or long side 34 (not shown) of the uniaxial tension focus mask 25, to provide gaps of about 0.4 mm (15 mils) therebetween that electrically isolate the first metal end strands 140 and form busbars that permit a second anode voltage to be applied to the second metal strands 60 when the conductive lead 65, embedded in the glass conductor layer 68, is connected to the second anode button 17.

What is claimed is:

1. A method for forming an insulator on one major surface of a uniaxial tension focus mask of a color selection electrode for a color cathode-ray tube, comprising the steps of a) positioning a mask sheet at a distance from a charging gun having a source of a dry-powdered insulative material, said mask sheet having a main body portion with a first major surface and an oppositely disposed second major surface, said mask sheet further including a plurality of first metal strands separated by openings extending through said main body portion thereof, from said first major surface to said second major surface, b) charging the dry-powdered insulative material and directing the charged, dry-powdered insulative material toward said first major surface of said mask sheet to provide a continuous coating on a least a portion thereof, and c) providing means for preventing the charged, dry-powdered insulative material from extending into said openings and being deposited onto said main body portion of said mask sheet surrounding each of said openings and said second major surface.

2. The method as described in claim 1, wherein said charging gun recited in step a) comprises a triboelectric gun and said means recited in step c) comprises a shield having a potential that repels the charged, dry-powdered insulative material and restricts the deposition thereof to said first major surface of said mask sheet.

3. The method as described in claim 1, wherein said charging gun recited in step a) comprises a primary electrostatic gun and said means recited in step c) comprises a secondary electrostatic gun spaced from said second major surface of said mask sheet, and mounted facing opposite said primary electrostatic gun said secondary electrostatic gun providing a stream of electrostatically charged air having a polarity opposite to that of the charged, dry-powdered insulative material, thereby discharging the charged, dry-powdered insulative material directed through said openings and restricting the deposition thereof to said first major surface of said mask sheet.

4. The method as described in claim 1, further including, after step c), the additional step of heating said mask sheet with said coating thereon to a temperature and for a time sufficient to sinter said coating to form a first insulator layer.

5. The method as described in claim 4, further including the additional steps of a) providing a plurality of second metal cross-strands, substantially perpendicular to said first metal strands, on said first insulator layer, b) repositioning said mask sheet at a distance from said charging gun having said source of said dry-powdered insulative material, c) charging and directing the charged, dry-powdered insulative material toward said first major surface of said mask to provide a continuous second coating on said first insulator layer, d) providing means for preventing the charged, dry-powdered insulative material from extending into said openings and being deposited onto said main body portion of said masking plate surrounding each of said openings and said second major surface, and e) heating said mask sheet with said continuous second coating of said dry-powdered insulative material thereon to a temperature and for a time sufficient to sinter said second coating and said second metal strands to said first insulator layer.

6. A method of making a uniaxial tension focus mask for a color cathode-ray tube having an electron gun for generating and directing three electron beams through openings in said uniaxial tension focus mask to a luminescent screen, comprising the steps of:

a) securing a uniaxial tension mask sheet to a substantially rectangular frame having two long sides and two short sides, said mask sheet having two long sides with a plurality of transversely spaced-apart first metal strands extending therebetween, the space between adjacent first metal strands defining parallel slots, said long sides of said mask sheet being attached to the long sides of said frame, said frame applying tension to said first metal strands of said mask sheet, b) forming a continuous insulator layer on a first major surface of said first metal strands of said mask sheet facing said luminescent screen across an effective picture area of said screen, by positioning a charging gun having a source of a dry glass powder at a distance from said first major surface and charging and directing said dry glass powder toward said first major surface of said first metal strands of said mask sheet to provide a continuous coating of said dry glass powder thereon, c) providing means for preventing said dry glass powder from extending into the parallel slots between adjacent first metal strands of said mask sheet and being deposited onto any portion of said mask sheet except said first major surface of said first metal strands, d) heating said mask sheet with said continuous coating of said dry glass powder thereon to a temperature and for a time sufficient to sinter said continuous coating to form a first insulator layer, e) providing a plurality of second metal cross-strands, substantially perpendicular to said first metal strands, on said first insulator layer, f) repositioning said charging gun, having said source of dry glass powder, at a distance from said first major surface of said mask sheet and charging and directing said dry glass powder toward said first insulator layer to provide a continuous second coating of said dry glass powder overlying said first insulator layer, g) providing means for preventing said dry glass powder from extending into the parallel slots between adjacent first metal strands of said mask sheet and being deposited onto any portion of said mask sheet except onto said first insulator layer, and h) heating said mask sheet with said continuous second coating of said dry glass powder thereon to a temperature and for a time sufficient to sinter said second coating and said second metal strands to said first insulator layer.

7. The method as described in claim 6, wherein said charging gun recited in steps b) and f) comprises a triboelectric gun and said means recited in steps c) and g) comprises a shield having a potential that repels the charged, dry-powdered insulative material and restricts the deposition thereof to said first major surface of said mask sheet.

8. The method as described in claim 6, wherein said charging gun recited in steps b) and f) comprises a primary electrostatic gun and said means recited in steps c) and g) comprises a secondary electrostatic gun spaced from said second major surface of said mask sheet, and mounted facing opposite said primary electrostatic gun said secondary electrostatic gun providing a stream of electrostatically charged air, having a polarity opposite to that of the charged, dry-powdered insulative material, thereby discharging the charged, dry-powdered insulative material directed through said openings and restricting the deposition thereof to said first major surface of said mask sheet.

9. An apparatus for forming an insulator on a mask sheet across an effective picture area of a screen of a cathode-ray tube, said mask sheet having two long sides and two short sides, said long sides being attached to a mask frame, said mask sheet including a plurality of transversely spaced-apart first metal strands extending between said long sides thereof, the space between adjacent first metal strands defining parallel slots, comprising a) a charging gun, having a source of a dry glass powder, positioned at a distance from a first major surface of said mask sheet, for charging and directing said dry glass powder toward said first major surface of said first metal strands of said mask sheet, and b) means for preventing the charged, dry glass powder from extending into the parallel slots between the adjacent first metal strands of said mask sheet and being deposited onto any portion thereof, except said first major surface of said first metal strands.

10. The apparatus as described in claim 9, wherein said charging gun recited in step a) comprises a triboelectric gun for triboelectrically charging said dry glass powder and said means recited in step b) comprises a shield having a potential that repels the triboelectrically charged, dry glass powder to restrict the deposition thereof to said first major surface of said first metal strands.

11. The apparatus as described in claim 9, wherein said charging gun recited in step a) comprises a primary electrostatic gun for electrostatically charging said dry glass powder and said means recited in step b) comprises a secondary electrostatic gun spaced from a second major surface of said mask sheet, and mounted facing opposite said primary electrostatic gun said secondary electrostatic gun providing a stream of electrostatically charged air, having a polarity opposite to that of the electrostatically charged, dry glass powder thereby discharging the electrostatically charged, dry glass powder directed through said parallel slots and restricting the deposition thereof to said first major surface of said first metal strands.

* * * * *